US009032724B2

(12) United States Patent
Pfaff et al.

(10) Patent No.: US 9,032,724 B2
(45) Date of Patent: May 19, 2015

(54) COMMAND BASED METHOD FOR ALLOCATING FLUID FLOW FROM A PLURALITY OF PUMPS TO MULTIPLE HYDRAULIC FUNCTIONS

(75) Inventors: Joseph L. Pfaff, Wauwatosa, WI (US); Eric P. Hamkins, Waukesha, WI (US); Corey K. Quinnell, West Allis, WI (US)

(73) Assignee: HUSCO International Inc., Waukesha, WI (US)

( * ) Notice: Subject to any disclaimer, the term of this patent is extended or adjusted under 35 U.S.C. 154(b) by 901 days.

(21) Appl. No.: 13/158,631

(22) Filed: Jun. 13, 2011

(65) Prior Publication Data

US 2011/0308242 A1 Dec. 22, 2011

Related U.S. Application Data

(60) Provisional application No. 61/356,780, filed on Jun. 21, 2010.

(51) Int. Cl.

| | |
|---|---|
| ***F15B 13/02*** | (2006.01) |
| ***F15B 11/17*** | (2006.01) |
| ***E02F 9/22*** | (2006.01) |

(52) U.S. Cl.

CPC ..... *F15B 11/17* (2013.01); *E02F 9/2242* (2013.01); *E02F 9/2292* (2013.01); *E02F 9/2296* (2013.01); *F15B 2211/20523* (2013.01); *F15B 2211/20546* (2013.01); *F15B 2211/20576* (2013.01); *F15B 2211/265* (2013.01); *F15B 2211/30575* (2013.01);

(Continued)

(58) Field of Classification Search

CPC ..... F15B 11/17; F15B 2211/20523; F15B 2211/20546; F15B 2211/20576; F15B 2211/265; F15B 2211/30575; F15B 2211/6306; F15B 2211/6309; F15B 2211/6313; F15B 2211/6346; E02F 9/2242; E02F 9/2292; E02F 9/2296

USPC ..... 60/327, 420, 421, 422, 425, 426, 428, 60/429, 430, 431, 459, 471

See application file for complete search history.

(56) References Cited

U.S. PATENT DOCUMENTS

| | | | | |
|---|---|---|---|---|
| 6,205,780 | B1 | 3/2001 | Zervas | |
| 6,498,973 | B2 * | 12/2002 | Dix et al. | 701/50 |

(Continued)

FOREIGN PATENT DOCUMENTS

| | | |
|---|---|---|
| CN | 1462345 A | 12/2003 |
| EP | 0874090 A1 | 10/1998 |

(Continued)

*Primary Examiner* — Dwayne J White
*Assistant Examiner* — Logan Kraft
(74) *Attorney, Agent, or Firm* — Quarles & Brady LLP

(57) ABSTRACT

Fluid from two pumps is allocated to a plurality of hydraulic actuators based on a plurality of flow commands, each specifying a desired amount of flow to be applied to a different hydraulic actuator. For a given hydraulic actuator, the allocation involves (1) determining an apportionment of the desired amount of flow, if no other hydraulic actuator is active, and (2) altering the apportionment in response to all the plurality of flow commands, and (3) using the altered apportionment to determine a first amount of the flow for one pump to provide and a second amount of the flow for the other pump to provide. The process is repeated for all the hydraulic actuators. Supply valves for each hydraulic actuator are controlled by the associated first and second amounts and each pump is controlled in response to either the first or second amounts for all the hydraulic actuators.

37 Claims, 7 Drawing Sheets

FIG. 2

(52) U.S. Cl.
CPC *F15B 2211/6306* (2013.01); *F15B 2211/6309* (2013.01); *F15B 2211/6313* (2013.01); *F15B 2211/6346* (2013.01)

(56) References Cited

U.S. PATENT DOCUMENTS

2002/0087244 A1 7/2002 Dix et al.
2007/0130927 A1* 6/2007 Pfaff ..... 60/327
2011/0056192 A1* 3/2011 Weber et al. ..... 60/327

FOREIGN PATENT DOCUMENTS

GB 2441258 A 2/2008
JP 2009167618 3/2009

* cited by examiner

FIGS. 4-8 SYMBOLS

- ◇ ARM FUNCTION
- ○ SWING FUNCTION
- ▷ BUCKET FUNCTION
- □ BOOM FUNCTION

COMMAND BASED METHOD FOR ALLOCATING FLUID FLOW FROM A PLURALITY OF PUMPS TO MULTIPLE HYDRAULIC FUNCTIONS

CROSS-REFERENCE TO RELATED APPLICATIONS

This application claims benefit of U.S. Provisional Patent Application No. 61/356,780 filed on Jun. 21, 2010.

STATEMENT REGARDING FEDERALLY SPONSORED RESEARCH OR DEVELOPMENT

Not Applicable

BACKGROUND OF THE INVENTION

1. Field of the Invention

The present invention relates to hydraulic equipment having a plurality of pumps each connected by a control valve arrangement to a plurality of hydraulic functions; and in particular to a method for allocating the flow of fluid from each pump to the plurality of hydraulic functions.

2. Description of the Related Art

Hydraulic systems for large machines, such as an earth excavator, often incorporate a number of hydraulic pumps in order to satisfy the demand for pressurized hydraulic fluid to drive various hydraulic actuators. A hydraulic actuator is a device, such as a cylinder-piston arrangement or a hydraulic motor that converts the flow of hydraulic fluid into mechanical motion. Because several of these hydraulic actuators on the machine can be operating simultaneously, the aggregate demand for hydraulic fluid flow is greater than can be provided by any single, reasonably sized, pump. In some previous hydraulic systems certain pumps were assigned to only selected ones of the hydraulic actuators and thus could not supply hydraulic fluid to all of the hydraulic actuators on the machine. This fundamental arrangement often produced an inefficiency when the demand for the hydraulic fluid from one group of actuators could not be satisfied by its permanently assigned pump and fluid was available from the other pump but could not be supplied to the demanding hydraulic actuators.

Other hydraulic systems allowed multiple pumps to supply fluid to the same hydraulic actuator. Nevertheless, the previous technique for doing so provided a fixed algorithm for each hydraulic actuator that defined for any given amount of fluid demand how that demand was satisfied with fluid from the two pumps. For example, at relatively low flow demands all of the demand was satisfied by fluid from one of the pumps until the demand reached a given percentage (e.g., 50%) of the maximum flow that could be produced by the pump. Thereafter, the additional flow requirements for the hydraulic actuator was satisfied by a combination of fluid from both of the pumps according to a predefined proportional relationship. That apportionment of fluid from the different pumps to any given hydraulic actuator was fixed and was not a function of the demands for fluid from other hydraulic actuators on the machine. In other words, regardless of whether any of the other hydraulic actuators also were operating simultaneously, the apportionment of fluid to each actuator was fixed and did not take into account the demand from other actuators. Therefore, an operator of the machine could command the activation of one hydraulic actuator which would begin to operate and then the operator could command another hydraulic actuator to begin operating simultaneously and the proportioning of fluid from the various pumps to each actuator was affected only by the operator command for that actuator and did not take into account the simultaneous commands for the other actuators. Such an independent operation of each actuator did not always produce the most efficient and energy conserving operation of the overall machine.

In order to produce optimal efficiency, the various pressure requirements of the different simultaneously operating actuators has to be taken into account. It has been commonplace on machines with multiple actuators to sense the load force on all of the hydraulic actuators and select the greatest of those load forces to use in controlling the outlet pressure of the pump. It's a fundamental concept that in order for an actuator to be able to move its load, the pressure of the hydraulic fluid applied to that actuator must produce a force that exceeds the force produced by that load. This often results in a hydraulic actuator that has a relatively small load acting thereon receiving pressure far greater than that which is required to move that load. As a consequence, when the fluid at that high pressure flows through a small opening in the control valve associated with this small hydraulic load, high heat losses are produced which therefore contribute to the inefficient operation of the hydraulic system. Therefore, to improve the efficiency of the overall machine, it is desirable to match the pump outlet pressure as closely as possible to the pressure requirements of the various hydraulic functions. Doing so minimizes the heat losses at each valve assembly. Many previous systems did not factor in the pressure requirements when allocating fluid to the different hydraulic functions.

SUMMARY OF THE INVENTION

The present method allocates fluid flow in a hydraulic system that has two or more pumps which provide pressurized fluid to a plurality of hydraulic functions. Each hydraulic function has a hydraulic actuator coupled to the pumps by a valve assembly that is selectively operated by a controller to govern the fluid flow. At least some of the hydraulic functions can receive pressurized fluid from more than one pump.

A separate flow command is received for each hydraulic function, such as by the operator manipulating a joystick for example. Each flow command determines an aggregate amount of fluid flow that is desired to be applied to the respective hydraulic function. The flow commands for all of the plurality of hydraulic functions are used to determine the particular magnitudes of fluid flow that each hydraulic function receives from any given pump. In other words the allocation of the fluid flow from each pump to each hydraulic function is based not only on the flow command for that respective hydraulic function, but also in response to the flow commands for the other hydraulic functions.

Then the amounts of fluid flow that each hydraulic function receives from a given pump are summed to provide an aggregate flow amount that is employed to control the output of the respective pump.

The present method further determines a separate function pressure setpoint for each of the plurality of hydraulic functions based on the forces acting on the respective hydraulic actuator. A separate pump pressure setpoint is established for each pump based on the function pressure setpoints and the amounts of fluid each hydraulic function receives from each pump. The extent to which each inlet valve in the valve assembly for a given hydraulic function opens is determined based on the function pressure setpoint and the fluid flow desired from the pump connected to the respective inlet valve.

The method also determines a maximum amount of power that is available for driving all the pumps. For example, this may be the maximum power output of an internal combustion engine on the machine containing the hydraulic system. If, in order to produce the desired aggregate flow amounts for all the active hydraulic functions, the total power required to drive all the pumps exceeds the maximum amount of available power, the maximum amount of available power is apportioned among the pumps. This is accomplished by adjusting at least some of the amounts of fluid flow allocated to each of the hydraulic functions. The adjustment of the fluid flow allocation to any given hydraulic function also depends of the flow allocations to other function that are operating simultaneously.

DETAILED DESCRIPTION OF THE INVENTION

Although the present invention is being described in the context of use on an excavator, it can be implemented on other types of hydraulically operated equipment.

Figure 1:
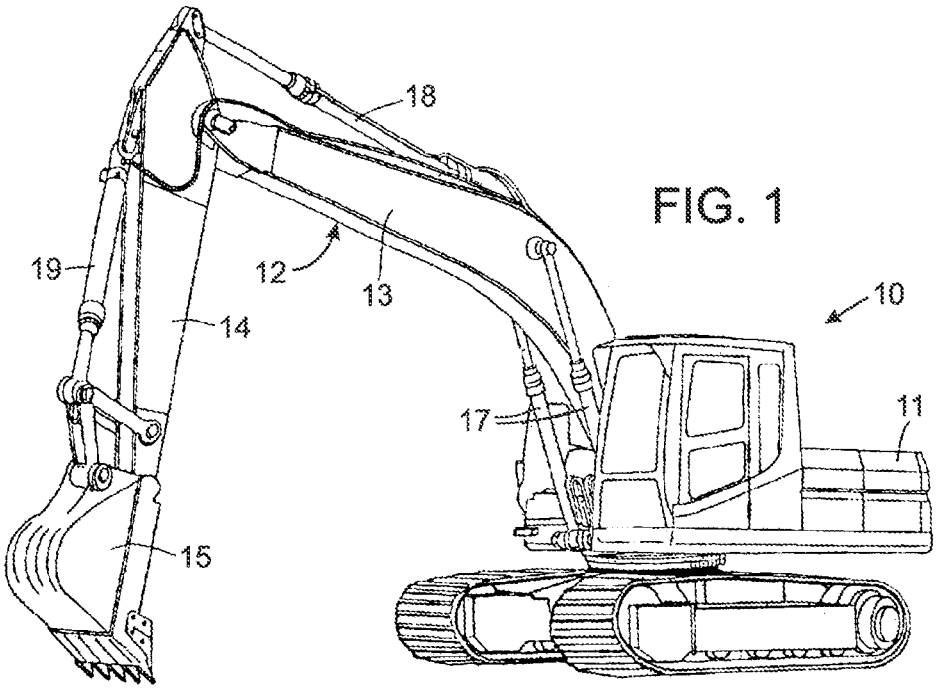
FIG. 1 is an isometric view of an excavator that incorporates a hydraulic system according to the present invention.

With initial reference to FIG. 1, an excavator 10 comprises a cab 11 that can swing on a crawler and a boom assembly 12 attached to the cab for up and down motion. A bidirectional hydraulic swing motor 16 (FIG. 2) selectively rotates the cab clockwise and counterclockwise with respect to the crawler. The boom assembly 12 is subdivided into a boom 13, an arm 14, and a bucket 15 pivotally attached to each other. The boom 13 is coupled to the cab 11 in order to pivot up and down when driven by a pair of hydraulic cylinder assemblies 17 that are mechanically connected in parallel between the cab and the boom. On a typical excavator, the cylinder of these assemblies 17 is attached to the cab 11 while the piston rod is attached to the boom 13, thus the force of gravity acting on the boom tends to retract the piston rod into the cylinder. Alternatively, the connection of the cylinder assemblies could be such that gravity tends to extend the piston rod from the cylinder. The arm 14, supported at the remote end of the boom 13, can pivot toward and away from the cab 11 in response to operation of another hydraulic cylinder assembly 18. The bucket 15 pivots at the tip of the arm when driven by yet another hydraulic cylinder assembly 19. The bucket 15 can be replaced with other work heads. The hydraulic swing motor 16 and the hydraulic cylinder assemblies 17-19 on the boom assembly 12 are generically referred to a hydraulic actuators, which are devices that convert hydraulic fluid flow into mechanical motion. The hydraulic system may include other types of hydraulic actuators and in particular other motors for driving the tracks of the crawler.

Figure 2:
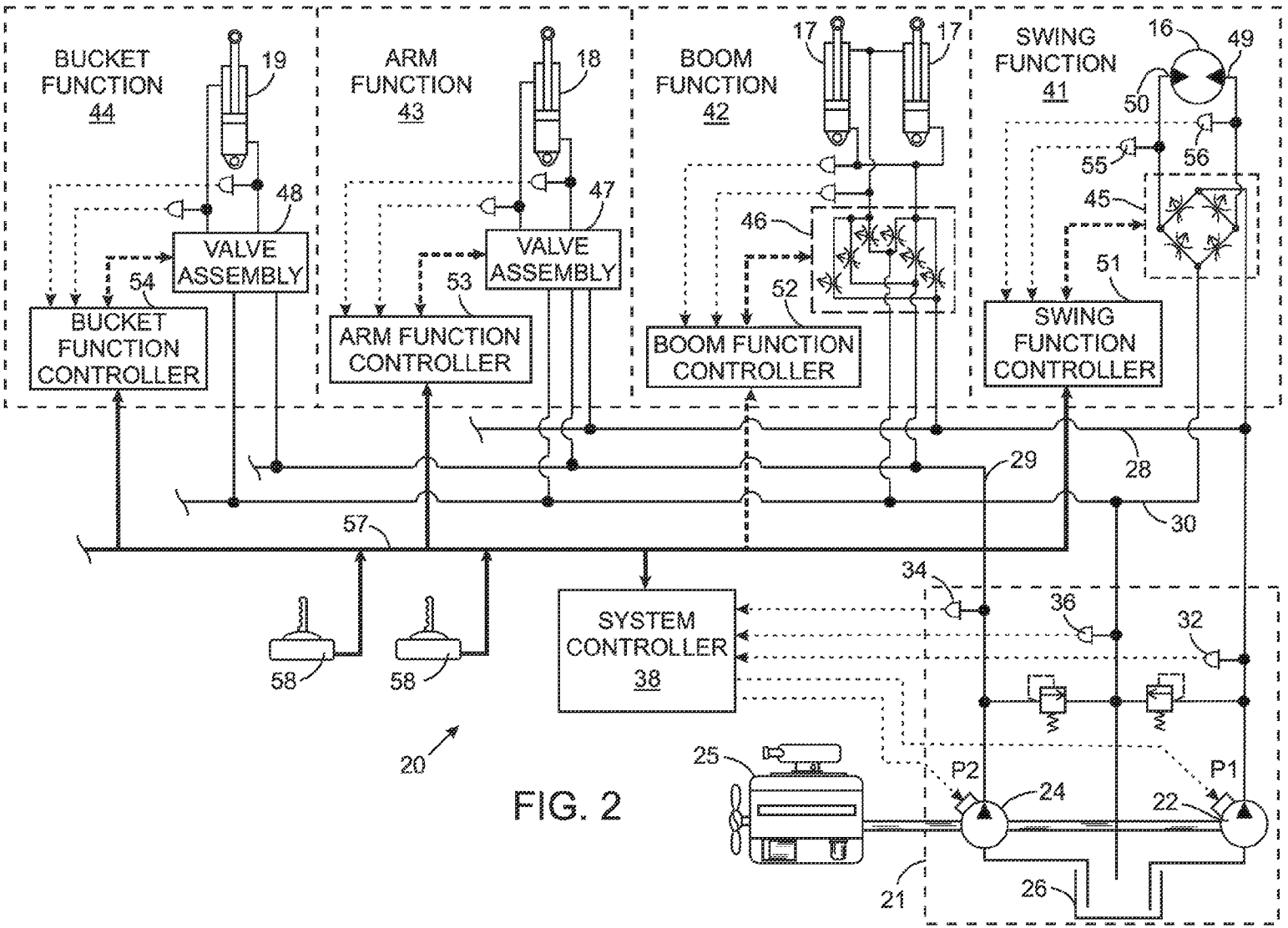
FIG. 2 is depicts a hydraulic system with two pumps that power hydraulic functions for moving a boom, an arm, a bucket, and the excavator cab.

With reference to FIG. 2, the hydraulic actuators 16-19 on the excavator 10 are part of a hydraulic system 20 that has a source 21 of pressurized hydraulic fluid, which includes a variable displacement first pump 22 and a variable displacement second pump 24. One skilled in the art will appreciated that the present method can applied to hydraulic systems with more than two pumps. When driven by an internal combustion engine 25, the two pumps 22 and 24 draw fluid from a common tank 26 and force the fluid under pressure into separate first and second supply conduits 28 and 29, respectively. The first and second supply conduits 28 and 29 furnish pressurized fluid to the hydraulic actuators on the excavator. After being used to power a hydraulic actuator the fluid flows back to the tank 26 via a return conduit 30. The two supply conduits 28 and 29 and the return conduit 30 extend from the fluid source 21, located in the cab 11, along both the boom 13 and the arm 14. Separate sensors 32 and 34 measure the pressures in the first and second supply conduits 28 and 29 and provide those pressure measurements to a system controller 38. Another sensor 36, also connected to the system controller 38, provides a measurement of the pressure in the return conduit 30. The system controller 38 supervises the overall operation of the hydraulic system 20. The system controller 38 also governs the displacement of the first and a second pumps 22 and 24 in a conventional manner based on the pressure measurements and the pressures required to operate the hydraulic actuators 16-19 at any given point in time.

Each hydraulic actuator 16, 17, 18 and 19 is part of a separate hydraulic function 41, 42, 43 and 44, respectively, each of which has a valve assembly 45, 46, 47 or 48 that couples the two ports of the associated hydraulic actuator to one or both of the supply conduits 28 and 29 and to the return conduit 30. Specifically the swing hydraulic function 41, for rotating the cab 11 on the crawler, comprises a first valve assembly 45 that couples the swing hydraulic actuator 16 to the first supply conduit 28 and the return conduit 30. The first valve assembly 45 has four electrohydraulic proportional valves, such as the type described in U.S. Pat. No. 7,341,236, connected in a Wheatstone bridge arrangement. In that arrangement, opening the valves in one pair of opposite legs of the bridge sends fluid from the first supply conduit 28 to a first port 49 of the swing hydraulic actuator 16 and conveys fluid from a second port 50 to return conduit 30. The various valves in the first valve assembly 45 are opened and closed in response to electrical control signals from a swing function controller 51. Opening the valves the other pair of opposite legs of the bridge reverses the fluid flow through the swing hydraulic actuator 16, i.e., fluid from the first supply conduit 28 is sent to the second port 50 of the swing hydraulic actuator 16 and fluid from the first port 49 is conveyed into return conduit 30. This alternate operation of the first valve assembly 45 drives the swing hydraulic actuator 16 in opposite directions. The swing function controller 51 receives signals from pressure sensors 55 and 56 at the ports of the swing hydraulic actuator 16, which indicate load forces acting on the hydraulic actuator.

The boom hydraulic function 42, for raising and lowering the boom 13 with respect to the cab 11, comprises a second valve assembly 46 that couples the boom hydraulic actuators 17 to both the first and second supply conduits 28 and 29 and to the return conduit 30. Each boom hydraulic actuator 17 has a cylinder with head and rod chambers. In the second valve assembly 46, one pair of electrohydraulic proportional valves couples the first supply conduit 28 to the head and rod cylinder chambers in each boom hydraulic actuator 17, and another pair of electrohydraulic proportional valves couples the second supply conduit 29 to the head and rod cylinder chambers in each boom hydraulic actuator 17. Yet another pair of electrohydraulic proportional valves couples those rod and head cylinder chambers to the return conduit 30. The six valves in the first valve assembly 46 are opened and closed in response to electrical control signals from a boom function controller 52. By opening selected valves in the second valve assembly 46, fluid from one or both of the supply conduits 28 and 29 is fed into one cylinder chamber of each boom hydraulic actuator 17 and fluid is drained from the other cylinder chambers into the return conduit 30. This valve operation enables the piston of the boom hydraulic actuators 17 to be selectively extended from and retracted into the associated cylinder thereby raising and lowering the boom 13. The boom function controller 52 receives signals from pressure sensors at the ports of the boom hydraulic actuator 17. Since the two boom cylinder assemblies are hydraulically connected in parallel and function in unison, they will be considered herein as a single hydraulic actuator for simplicity of explanation.

The arm hydraulic function 43, for pivoting the arm 14 bidirectionally about the remote end of the boom 13, comprises a third valve assembly 47 that couples the arm hydraulic actuator 18 to the first and second supply conduits 28 and 29 and to the return conduit 30. The third valve assembly 47 has the same configuration of six valves as in the second valve assembly 46 and is operated by an electrical control signals from an arm function controller 53. Opening selected valves in the third valve assembly 47 applies fluid from one or both of the supply conduits 28 and 29 into one cylinder chamber of the arm hydraulic actuator 18 and drains fluid from the other cylinder chamber into the return conduit 30. This valve operation selectively extends and retracts the piston of the arm hydraulic actuator 18 with respect to the associated cylinder thereby bidirectionally pivoting the arm 14. The arm function controller 53 receives signals from pressure sensors at the ports of the arm hydraulic actuator 18.

The bucket hydraulic function 44, for pivoting the bucket 15 at the remote end of the arm 14, comprises a fourth valve assembly 48 that couples the bucket hydraulic actuator 19 to the second supply conduit 29 and the return conduit 30. The fourth valve assembly 48 comprises a set of four electrohydraulic proportional valves connected in a Wheatstone bridge arrangement to the two ports of the cylinder for the bucket hydraulic actuator 19 in the same manner as in the first valve assembly 45. By opening a pair of valves in opposing legs of the bridge applies fluid from the second supply conduit 29 into one cylinder chamber of the bucket hydraulic actuator 18 and drains fluid from the other cylinder chamber into the return conduit 30. The cylinder chamber that receives pressurized fluid from the second first supply conduit 29 is determined by which pair of opposing valves is opened. This valve operation selectively determines whether the bucket hydraulic actuator 19 extends or retracts, thereby bidirectionally pivoting the bucket 15. Operation of the fourth valve assembly 48 is governed by a bucket function controller 54 that receives signals from pressure sensors at the ports of the bucket hydraulic actuator 19.

On this particular excavator 10, the swing hydraulic actuator 16 can only be connected to the first supply conduit 28, and not to the second supply conduit 29. Similarly, the bucket hydraulic actuator 19 can only be connected to the second supply conduit 29, and not to the first supply conduit 28. Nevertheless, the swing and bucket hydraulic functions 41 and 44 could be modified to incorporate valve assemblies identical to the second valve assembly 46 so that the swing hydraulic actuator 16 and the bucket hydraulic actuator 19 can receive fluid from both the first and second supply conduits 28 and 29.

As noted previously, operation of the four valve assemblies 45, 46, 47 and 48 is controlled by a separate function controller 51, 52, 53 and 54, respectively. The system controller 38 and the function controllers 51-54 incorporate microcomputers that execute software programs which perform specific tasks assigned to the respective controller, as will be described. Each function controller is collocated with the associated valve assembly adjacent the respective hydraulic actuator being controlled. The function controllers 51-54 receive operational commands from the system controller 38 and send data to the system controller. Those commands and data are exchanged via a conventional communication network 57, such as for example the Controller Area Network (CAN) serial bus that uses the communication protocol defined by ISO-11898 promulgated by the International Organization for Standardization in Geneva, Switzerland. Two joysticks 58 are also connected to the communication network 57 so that the human operator of the excavator 10 can provide input commands to the system controller 38. The communication network 57 also carries data and commends between the engine, transmission, other components, and other computers on excavator 10.

When the operator of the excavator 10 desires to move a part of the boom assembly 12, the associated joystick 58 is manipulated by an amount that corresponds to the velocity (i.e. direction and speed) of the desired motion. This produces a velocity command for the associated hydraulic function. The system controller 38 receives the velocity command which then is converted into a function command that is sent by the system controller to the appropriate function controller 51-54. The function command designates the amount of flow that the function is to draw from each pump 22 and 24 via the respective supply conduits 28 and 29. The recipient function controller 51-54 responds to the function command by determining which valves within the associated valve assembly 45-48 need to be opened and by what amount in order to send the commanded flow to the respective hydraulic actuator to produce the desired motion. The respective function controller 51-54 then determines the magnitude of electric currents to apply to open the selected valves the requisite amount and those currents are fed to the respective valves.

Specifically, when motion of the swing hydraulic function 41 is desired, the velocity command is translated by the system controller 38 into a function command that instructs the swing function controller 51 as to the direction of the actuator motion and the desired fluid flow to draw from the first supply conduit 28. The swing function controller 51, the determines which supply conduit and return conduit valves need to open for that motion direction and the amount to open each valve to produce the desired fluid flow. When motion of the bucket hydraulic function 44 is desired a similar operation occurs with respect to the bucket function controller 54, except that the fluid is to be drawn from the second supply conduit 29.

A slightly different operation occurs when motion of the boom hydraulic function 42 or the arm hydraulic function 43 is commanded since these functions may draw fluid from either or both of the first and second supply conduits 28 and 29. In those cases, system controller 38 instructs the associated function controller 52 or 53 the relative amount of fluid flow, if any, to draw from each supply conduit 28 and 29. This instruction command then is used by the associated function controller 52 or 53 to determine which valves should be opened and by what amount to draw fluid from one or both of the supply conduits 28 and 29.

The present invention is directed toward a method by which the system controller 38 allocates fluid from the two supply conduits 28 and 29, and thus from their respective pumps 22 and 24, to the hydraulic functions 41-44 that are active at any point in time. To simplify description of allocating the fluid from the two pumps 22 and 24, only the operation of the valves that couple the first and second supply conduits 28 and 29 to one of the ports of the various hydraulic actuators will be described. Nevertheless, it should be understood that at the same time, a valve coupling the other port of the hydraulic actuator to the return conduit 30 also is opened. Also the fluid allocation method is the same regardless of which port of a particular hydraulic actuator is receiving fluid from one of both of the supply conduits 28 and 29, and thus in which direction a hydraulic actuator 41-44 is moving, except that different inlet valves are opened. It should be understood that the present flow allocation method can be used with hydraulic systems that have more than two pumps.

Since the swing hydraulic function 41 can only receive fluid from the first pump 22 and the bucket hydraulic function 44 may only receive fluid from the second pump 24, the allocation of fluid to those functions is straightforward as all of the fluid necessary to satisfy the machine operator's command for those functions must come from only one pump. When either the boom hydraulic function 42 or the arm hydraulic function 43 is active, the flow allocation becomes more involved because the total demand for fluid by those functions may come from either one or both of the first and second pump 22 and 24. Thus, the flow requirements can be apportioned between the two pumps on a continuum from one pump to the other pump.

Figure 3:
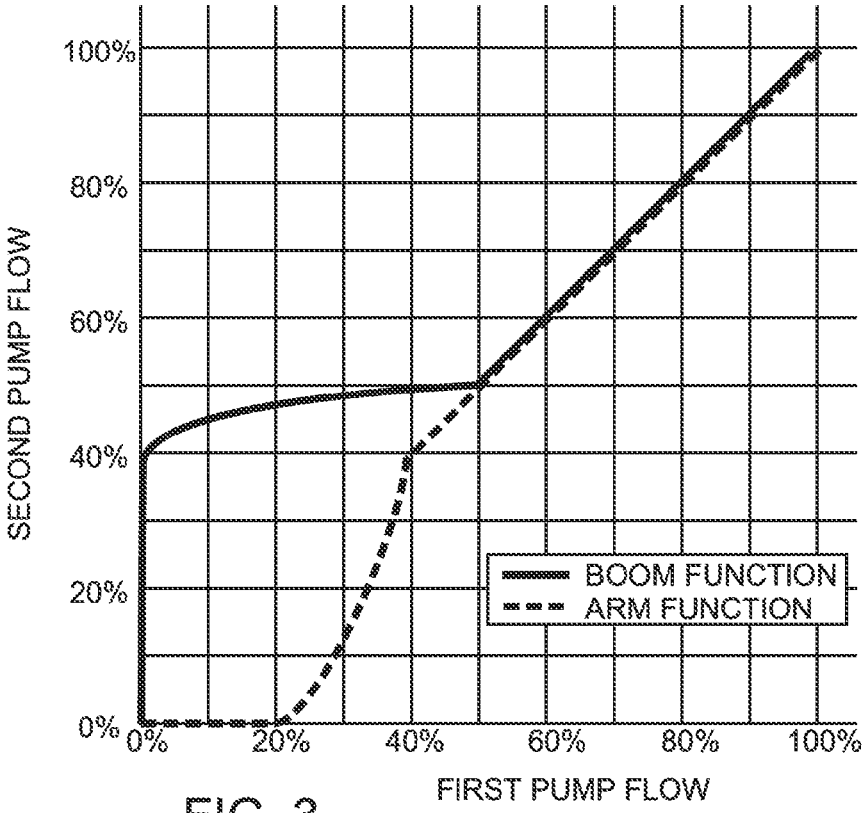
FIG. 3 is a graph depicting allocation of the output fluid flows from two pumps in the hydraulic system when only either the boom hydraulic function or the arm hydraulic function is operating.

The flow allocation is depicted by a two-dimensional graph in FIG. 3, in which the output of the first pump 22 that is allocated to a hydraulic function is represented on the horizontal axis, and the allocated output of pump 2 is represented on the vertical axis. Thus, the fluid flow to the swing hydraulic function 41 always lies on the horizontal axis of the graph and the flow to the bucket hydraulic function 44 always lies on the vertical axis. Because the flow fed to the boom and arm hydraulic functions 42 and 43 can come from one or both of the pumps 22 and 24, the point depicting the fluid allocation to each of those hydraulic functions can lie anywhere on the graph. The present method is directed to selecting the operating point on the flow allocation graph for each hydraulic function considering efficiency and productivity of the entire hydraulic system. The flow allocation point for each hydraulic function is selected based on the flow commands for all the other simultaneously active hydraulic functions. The flow operating points for each of the pumps 22 and 24 is derived based on the aggregate flow required by all of the simultaneously active hydraulic functions. The flow allocation may be adjusted if the maximum power available from the engine 25 is inadequate to drive the pumps to satisfy the flow and pressure demands of the hydraulic functions.

The flow allocation is described herein as a percent of the maximum flow from a given pump rather that absolute flow quantities. Using percentages makes the flow allocation process easily adaptable to hydraulic systems that employ pumps which have different maximum flow capacities by merely specifying the maximum flow capacity of each pump. In the exemplary hydraulic system 20, the first and second pumps have the identical maximum flow capacities, however, that does not have to be the case for all machines on which this flow allocation method is used.

Considering a simple state of the excavator operation in which only the boom hydraulic function 42 is active, it might be intuitive to only use fluid from one of the two pumps 22 or 24. It should be considered, however, that operation of only one function on the machine typically occurs for only a brief period of time before at least one other function is also commanded into operation. Therefore, it is desirable at some point during the operation of only a single function to begin obtaining fluid also from the other pump so that both pumps are already engaged and supplying fluid when operation of another function is commanded. Operating in this manner provides more flexibility in changing the allocation since two pumps are already actively online. This technique also provides a smoother flow transition between the two pumps 22 and 24.

Thus, as shown by the solid "flow allocation trajectory" line in FIG. 3, when the boom hydraulic function 42 alone begins operating, all the fluid flow is supplied by the second pump 24. As the machine operator manipulates the joystick 58 to command faster motion of the boom hydraulic function, the amount of hydraulic fluid supplied to that function increases thus increasing the percentage of the maximum flow from the second pump 24 that is to be produced and fed to that function. When the flow command exceeds 40% of the maximum flow available from the second pump, some of the additional flow demand is satisfied by the first pump 22, as depicted by the solid line moving away from the vertical axis. Prior to reaching the 40% flow level, only the inlet valve in valve assembly 46 for the second supply conduit 29 was open so that all the required fluid flow came from the second pump 24. When the flow demand increases above the 40% flow level, the inlet valve for the first supply conduit 28, connected the first pump 22, also opens. Immediately thereafter, the inlet valve for fluid from the first pump 22 continues opening at a faster rate than the inlet valve for fluid from the second pump 24. Eventually both of the pump flow levels reach 50% of their maximum capacities, and the remaining allocation of fluid increases equally from each pump as denoted by the solid allocation line having a unity slope. As will be described, the shape of the flow allocation line for the boom hydraulic function 42 is defined by values stored in the memory of the system controller 38.

A similar flow allocation trajectory, denoted by the dashed line in FIG. 3, is defined for when only the arm hydraulic function 43 is operating. In that case, the fluid flow initially comes from only the first pump 22 via the inlet valve in valve assembly 47 that is connected to the first supply conduit 28. When the arm hydraulic function demands 20% of the maximum flow available from the first pump 22, a transition occurs in which some of the additional required flow is supplied by the second pump 24. At that time, the inlet valve connected to that second supply conduit 29 begins opening. As the flow demanded by the arm hydraulic function 43 continues to increase, the amount of flow from the second pump 24 increases faster than the flow increase of the first pump 22. Eventually when the flows from both pumps reaches 40% of their individual maximum flows, continued increases in flow demand are apportioned equally between the two pumps as indicated by a unity slope dashed line to the 100% flow level.

It should be understood that the maximum flow required by a given hydraulic function to satisfy the commanded operation may be greater than the maximum amount of flow that either one of the two pumps 22 or 24 alone may supply. These flow allocation trajectories for the boom and arm hydraulic functions are exemplary and may vary from machine to machine.

As the amount of fluid flow required to operate the hydraulic functions increases, the percentage of the maximum flow produced by one or both of the first and second pumps 22 and 24 must increase to satisfy that demand. To increase that flow percentage, the system controller 38 selectively varies the displacements of those two pumps to provide sufficient fluid into the respective first and second supply conduits 28 and 29.

FIG. 3 denotes the flow allocation curves when only either the boom hydraulic function 42 or the arm hydraulic function 43 is operating alone. The respective allocation trajectory bends the graph as other hydraulic functions become active, thus requiring some of the flow capacity from the two pumps. Thus the allocation of fluid flow from each pump to each of the boom and arm hydraulic function depends upon the flow commanded for other simultaneously operating hydraulic functions. That dynamic shifting of the flow allocation points forms the a principal feature of the present flow allocation method.

When two or more hydraulic functions 41-44 are operating, they may require fluid at different pressures in order to drive the respective hydraulic actuators against the external load forces acting on the respective hydraulic actuators 16-19. For example, to operate the boom hydraulic function 42 and drive the hydraulic actuator 17 to raise the boom 13, the force exerted by the mass of the boom assembly 12 and any contents of the bucket 15 must be overcome. Therefore, the pressure of the hydraulic fluid fed to the boom hydraulic actuator 17 has to be greater than the pressure in its head chamber due to the actuator load. If the bucket 15 is to curl simultaneously, the respective load force acting on its hydraulic actuator 19 typically will be significantly less than the load force on the boom hydraulic actuator 17. In that situation, the bucket hydraulic actuator 19 requires fluid at a lower pressure. Although both of these hydraulic actuators 17 and 19 could be fed from the same hydraulic pump using the relatively high pressure necessary to raise the boom 13, application of that high pressure to the bucket hydraulic function 44 is inefficient because of heat losses as the pressurized fluid flows through the associated valve assembly 48. It is more advantageous instead to furnish the bucket hydraulic function 44 with fluid at a lower pressure that satisfies its load requirements and that does not produce as great a heat loss.

Figure 4:
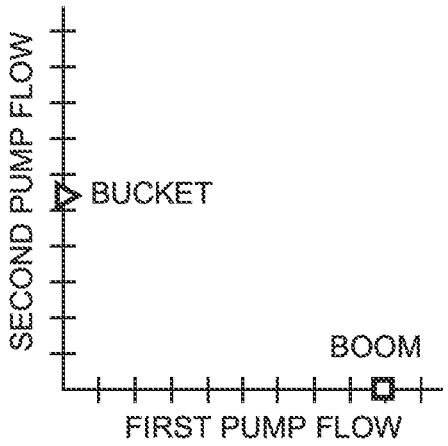
FIGS. 4-8 graphically depict allocation of fluid flow from the two pumps when different pairs of the hydraulic functions are operating simultaneously.

Therefore, a fundamental concept of the present flow allocation method is that if the boom hydraulic function 42 is utilizing fluid from the second supply conduit 29 and the second pump 24, it is desirable when the bucket hydraulic function 44 becomes operational to transition the boom hydraulic function to the first pump 22 since the bucket hydraulic function can only receive fluid from the second pump 24. In this manner, the output pressure from the second pump 24 can be reduced to the level required by the bucket hydraulic function with the greater pressure required by the boom hydraulic function being provided by the first pump 22. Thus in this situation the flow allocation trajectory for the boom hydraulic function 42 in FIG. 3 bends toward the horizontal axis for the first pump 22 reaching a flow allocation point as depicted in FIG. 4. This allocation to separate pumps continues until one of those functions reaches 100% of its assigned pump's maximum capacity, after which time any additional fluid demand is satisfied by any extra capacity of the other pump.

Figure 5:
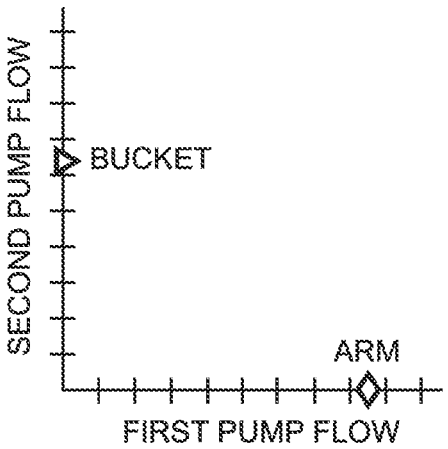

FIG. 5 depicts the flow allocation for a similar situation in which only the arm and bucket hydraulic functions 43 and 44 are commanded simultaneously. Here the arm hydraulic function is allocated fluid from only the first pump 22 in order to reduce operational efficiency due to different pressure requirements.

Figure 6:
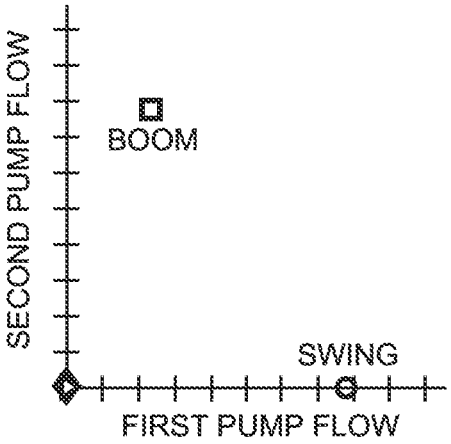
Figure 7:
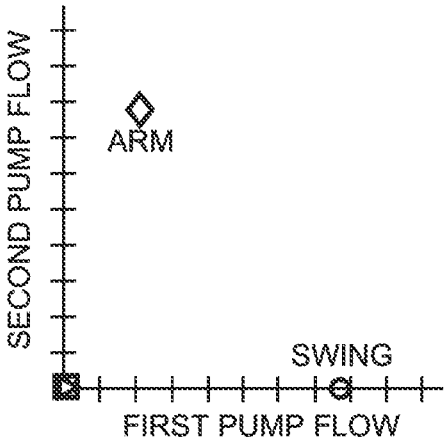

Consider now the condition in which the swing hydraulic function 41 is commanded at the same time either the boom hydraulic function 42 or the arm hydraulic function 43 also is being commanded. The swing hydraulic function 41 is unique among the functions shown in FIG. 2 in that a structural load does not act on the swing hydraulic actuator 16. Only inertia acts on the swing hydraulic function 41. As a result, it is desirable not to isolate the swing hydraulic function totally from the boom or arm hydraulic function. Such isolation could result in the cab 11 swinging so fast as to reach the desired rotational position before the boom 13 has been adequately raised. In other words as a practical matter, the operator usually wants the boom to be raised to the desired height in about the same time that the cab swings to its desired position. Therefore, if the boom or arm hydraulic function 42 or 43 has a relatively large flow command, thereby requiring a high percentage of the maximum output of the second pump 24, it is desirable to have the first pump 22 also supply fluid to the boom or arm hydraulic function, provided the pressure requirement of the swing hydraulic function 41 is greater than that of the other active hydraulic function. As shown in FIGS. 6 and 7 respectively, the boom hydraulic function 42 and the arm hydraulic function 43 in the flow allocation strategy do not receive fluid solely from the second pump 24 and thus their flow allocation points do not lie on the vertical axis. Instead, either the boom or arm hydraulic function 42 or 43 receives some fluid from the first pump 22.

Figure 8:
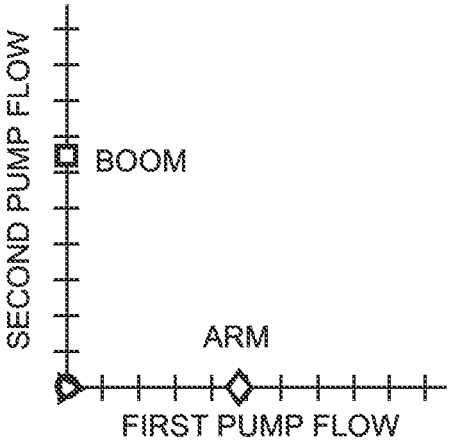

With reference to FIG. 8, when the boom and arm hydraulic functions 42 and 43 are commanded simultaneously without any other functions operating, the strategy is to have the boom hydraulic actuator 17 receive fluid from pump 2 and the arm hydraulic actuator 18 receive fluid from pump 1. Thus the present method results the respective flow allocation trajectory in FIG. 3 bending to align with the associated pump 22 or 24.

As a consequence, the fundamental principle is that when only two hydraulic functions are operating, each function to a different one of the two pumps 22 and 24. One minor exception being that, when certain flow command relationships exist between the swing hydraulic function 41 and another hydraulic function 42-44, the other function may receive some of the fluid from the first pump that is primarily supplying the swing hydraulic function. It should be understood that when those functions begin operating at different times, it may be necessary to transition or redirect the flow being furnished to a function from one pump to another.

When two or more hydraulic functions are operating simultaneously, the present flow control method involves flow allocation, pressure state transitions, and engine power control. The flow allocation depends upon the operator commands for the hydraulic functions on the machine. In response to those commands, flow for a given function may be redirected from one pump to another in a proportional manner. At the same time that the flow is being managed or allocated, the pressure states of the hydraulic functions also are examined. Specifically, as various hydraulic functions are transferred from one pump to another, the outlet pressure of the pumps may dynamically change in order to provide only that level of pressure which is needed to adequately power the hydraulic functions assigned to that pump. For example, if one hydraulic function requiring a high pressure is transitioned from the first pump to only the second pump, the pressure produced by the first pump may be reduced if the remaining hydraulic functions receiving its fluid do not require as great a pressure. In addition, engine power must be considered as the engine 25 driving the two pumps 22 and 24 has a finite power output which thereby provides a practical limit on the aggregate amount of flow that both pumps can produce. The present methodology involves first allocating the flow from the two pumps to the various active hydraulic functions, then defining the necessary outlet pressure for each pump, and finally allocating the available engine power between the pumps.

When multiple hydraulic functions are operating simultaneously, the flow trajectory shown in FIG. 3 for when either the boom or arm hydraulic function alone is operating, is bent depending upon the operator commands for the other simultaneously operating hydraulic functions. Thus, the flow allocation of each hydraulic function varies depending upon the flow commands from the operator for all the hydraulic functions that are desired to operate simultaneously. That flow allocation process involves the following steps which will be described in greater detail hereinafter.

1. Calculate pump output percentage flow command for each function.
2. Calculate an initial pump bias for each function based on the associated operator flow command.
3. For each hydraulic function, calculate a final pump bias based on its initial pump bias and the percent flow commands for all the functions.
4. Translate the final pump biases into output flow percentages for each pump.
5. Use the pump flow percentages to convert the original operator flow commands into allocated flow commands.
6. Translate final pump biases into pressure setpoint percentages for the first and second pumps.
7. Calculate the pump pressure setpoints.
8. Derive an engine power limit based on the pump output flows and pressure setpoints.
9. If necessary, adjust the pump output flows and hydraulic functions to comply with the engine power limit.

Figure 9:
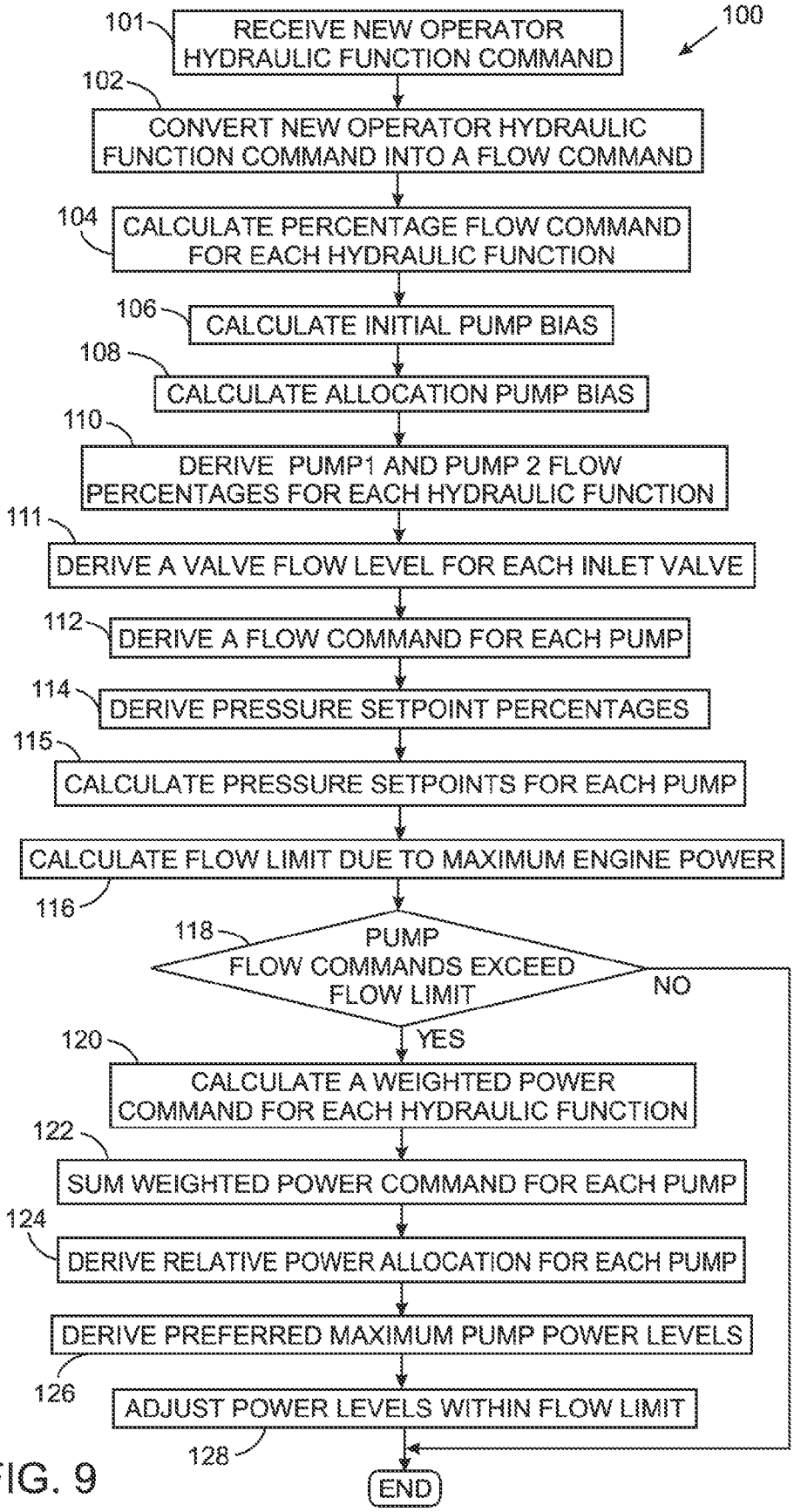
FIG. 9 is a flow chart of the flow allocation process.

This process is shown in the flowchart of FIG. 9. The software for flow allocation process 100 is executed each time that a new operator hydraulic function command is received by the system controller 38 from the joysticks 58, at step 101. At step 102, the new operator hydraulic function command, as indicated by the magnitude of the joystick signal, is converted into a flow command (Q_cmd) designating the amount of flow necessary to move the hydraulic actuator for that function as desired by the operator. Next, at step 104, a percentage flow command is calculated for each hydraulic function that is active. This is accomplished by dividing the combined, or aggregate, maximum flow (Q_max) that can be produced by all the pumps 22 and 24 by the flow command (Q_cmd) for the respective hydraulic function. In the exemplary hydraulic system, both the first and second pumps 22 and 24 have the same maximum flow capacity. The result of this calculation is a set of percentage flow command (%_Q_Cmd) for each of the active hydraulic functions. A non-zero percent flow command designates that the corresponding hydraulic function is active at this time.

Figure 10:
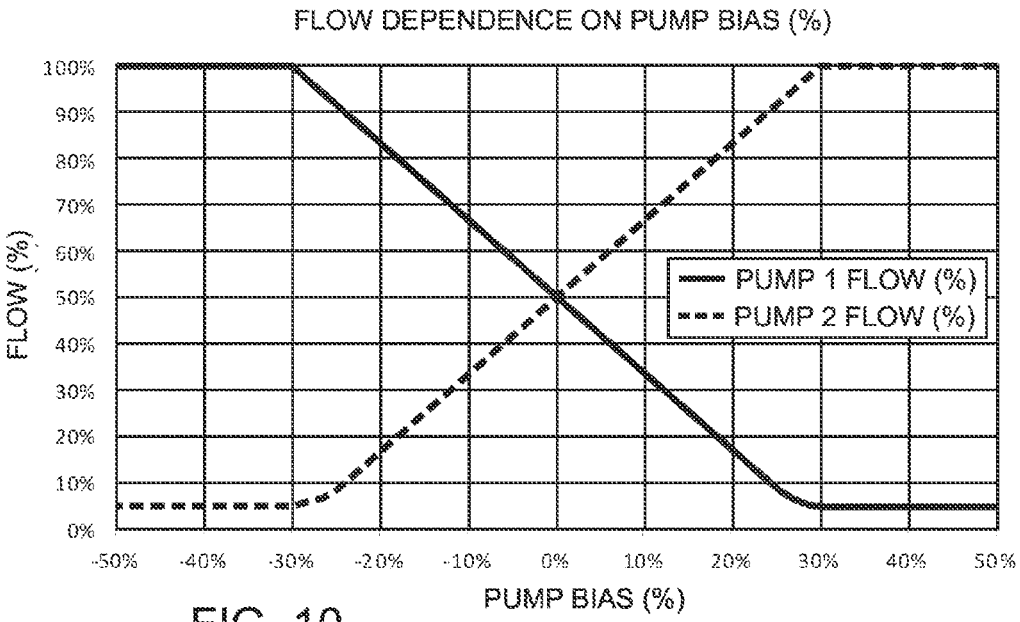
FIG. 10 graphically illustrates a translation relationship between a pump bias value and a flow percentage for each of the two pumps.

Thereafter at step 106, an initial pump bias value is calculated for each active hydraulic function. This initial pump bias establishes the associated function's single function flow allocation trajectory, such as for example, for the boom and arm hydraulic functions as depicted in FIG. 3. FIG. 10 graphically depicts a translation relationship between the pump bias and the pump flow percent for the first and second pumps. As can be seen from the graph, when the pump bias is zero percent, each pump provides 50% of the corresponding hydraulic function's flow requirement. When the pump bias is less than −30%, the first pump 22 provides substantially all the flow demand for the hydraulic function while the second pump 24 merely provides a small amount (e.g., 1% to 5%). Similarly at a pump bias of at least 30%, the second pump 24 provides substantially all the flow demand for the hydraulic function while the first pump 22 merely provides a small amount. It should be understood that whenever the boom or arm hydraulic function 42 or 43 is receiving substantially all the fluid flow requirements from one pump, the other pump still is supplying a small amount of fluid. This is desirable, so that the valve for that other pump is opened a small amount to reduce the latency of valve operation should a greater amount of flow from other pump be required at a later time. Thus the "pump bias" is a numerical value that specifies amounts of the flow from each of the first and second pumps 22 and 24 that are to be consumed by a given hydraulic function, and the "initial pump bias" specifies those flow amounts when the given hydraulic function is operating alone.

Using the arm hydraulic function 43 as an example, the flow allocation trajectory in FIG. 3 begins by using fluid only from the first pump 22 and then evolves to receiving fluid equally from both pumps as the operator command increases. Therefore the initial pump bias for the arm hydraulic function has values in the −50% to 0% range on FIG. 10. Thus the minimum initial pump bias (Min_Bias) is −50% and a maximum initial pump bias (Max_Bias) is 0%.

Figure 11:
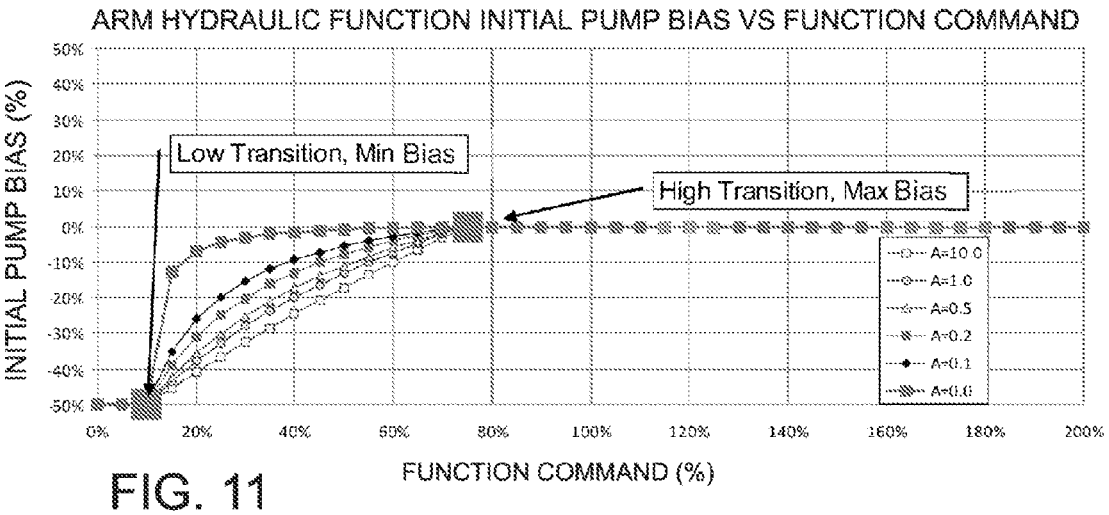
FIG. 11 is a graph showing an effect of different values of a variable A on an initial pump bias for a hydraulic function.

The initial pump bias for a hydraulic function is given by the expression:

```
IF(%_Q_Cmd < Low_Transition)
   Initial Pump Bias = Min_Bias,
Else If (%_Cmd > High_Transition)
   Initial Pump Bias = Max_Bias
Else
   Initial Pump Bias = A/((%_Q_Cmd − B) + C)
```

where %_Q_Cmd is the percent flow command for the function defined at step 104, the Low_Transition specifies a value for the percent flow command at which the minimum initial pump bias (Min_Bias) is achieved, and the High_Transition specifies a value for the percent flow command at which the maximum initial pump bias (Max_Bias) is achieved. The values for the Low_Transition and High_Transition terms are empirically determined based on the operation characteristics of a given type of machine. For an excavator, better system efficiency may be achieved when the boom or arm hydraulic function receives fluid from substantially only one pump at low flow commands. At relatively high flow commands, it may be preferred that both pumps provide fluid to the boom or arm hydraulic function so that both pumps are operating. This will result in less hydraulic disturbance when another hydraulic function also begins operating and requires a change of the flow allocation to the boom or arm hydraulic function. The value for the Low_Transition specifies how long the particular hydraulic function operates on only one pump and the High_Transition value specifies when both pump provide equal amounts of fluid to the hydraulic function. The term "A", in the initial pump bias expression above, is a constant that defines linearity of a transition between the minimum and maximum bias points. FIG. 11 provides an example of different values of A for the initial pump bias of the arm hydrau lic function. The term "B", in the initial pump bias expression, is a variable calculated utilizing the expression:

$$B=(\text{Low_Transition}+\text{High_Transition})/2-\text{SQRT}((\text{Low_Transition}-\text{High_Transition})\hat{}2/4-A*(\text{Low_Transition}-\text{High_Transition})/(\text{Min_Bias}-\text{Max_Bias})).$$

C is calculated using the values of A and B according to the equation:

$$C=\text{Max_Bias}-(A/(\text{High_Transition}-B)).$$

For the exemplary flow allocation trajectory of the arm hydraulic function depicted in FIG. 3, the Low_Transition is 10%, the High_Transition has a value of 75%, the Min_Bias is −50%, the Max_Bias is 0% and A is zero.

Next at step 108, the initial pump bias for each hydraulic function 41-44 is employed to calculate an allocation pump bias (Pump_Bias) that takes into account the influence from other hydraulic functions on the fluid allocation to the function being calculated. The allocation pump bias is derived according to the equation.

$$\text{Pump_Bias}=\text{Initial_Pump_Bias}+\text{SUMPRODUCT}(\%_Q_Cmd(n), \text{Flow_Allocation_Gain}(n))$$

where %_Q_Cmd(n) is the percent flow command of the nth hydraulic function and Flow_Allocation_Gain(n) is a gain constant for the nth hydraulic function. In the exemplary hydraulic system 20 with four hydraulic functions, n equals four. The Flow Allocation Gain for each function defines the amount of influence, that is the relative weight, that the respective hydraulic function, in comparison to the other hydraulic functions, has on the overall flow allocation from the two pumps 22 and 24 and is a numerical term with a sign and a magnitude. The sign establishes the flow allocation direction, i.e. an allocation preference, toward either the first or second pump. For example, a negative sign moves the flow allocation toward the first pump 22, whereas a positive sign moves the flow allocation toward the second pump 24. The magnitude of the Flow Allocation Gain designates the amount of that movement. In the exemplary system, the Flow Allocation Gain is between −1.0 and +1.0 inclusive. The resultant allocation pump bias (Pump_Bias) designates the degree that the flow allocation trajectory defined when the given function is operating alone moves toward either pump 1 or pump 2 due to the influence of operator commands for other hydraulic functions.

At step 110, the allocation pump bias (Pump_Bias) is employed to derive flow percentages of fluid from the first and second pumps 22 and 24 for each hydraulic function 41-44. This calculation employs the equations:

$$\text{Pump1_Flow_\%}=\text{MIN}(100\%,\text{MAX}(FA_\text{Min_Flow}, 50\%-\text{Pump_Bias}/(FA_\text{Flow_Range})))$$

$$\text{Pump2_Flow_\%}=\text{MIN}(100\%,\text{MAX}(FA_\text{Min_Flow}, 50\%+\text{Pump_Bias}/(FA_\text{Flow_Range})))$$

where FA_Min_Flow is a minimum flow percentage that must be furnished to the function by the associated pump. As noted previously, receiving at least a small amount of fluid from each pump reduces response latency when a reallocation of pump flows is required. Hence, the present method has a minimum flow level that each pump provides to every active hydraulic function. The FA_Flow_Range is a parameter that defines the width of the flow allocation range in which each pump supplies more than the minimum flow level. For the example depicted in FIG. 10 the FA_Flow_Range is 60 percent (Pump Bias values −30% to +30%) and the FA_Min_Flow is 5%.

At step 111, each pump flow percentage Pump1_Flow_% and Pump2_Flow_% for each hydraulic function is multiplied by that function's original flow command (Q_cmd) to produce a set of first and second flow levels for the first and second inlet valves of that hydraulic function which respectively control fluid from the first and second pumps 22 and 24. The resultant sets of first and second flow levels are used by the respective function controllers 51-54 to open each inlet valve in the associated valve assemblies 45-48 by an amount that provides the associated flow level.

Then at step 112, the first flow levels for all the hydraulic functions are summed to produce a first pump flow command (P1_Q_cmd) for the first pump 22, and the second flow levels for all the hydraulic functions are summed to produce a second pump flow command (P2_Q_cmd) for the second pump 24. These calculations are defined by the following arithmetic expressions:

$$P1_Q_cmd=\Sigma(\text{Pump1_Flow_\%}(n)*Q_cmd(n))$$

$$P2_Q_cmd=\Sigma(\text{Pump2_Flow_\%}(n)*Q_cmd(n)).$$

Nevertheless first pump flow command (P1_Q_cmd) and the second pump flow command (P2_Q_cmd) cannot exceed the maximum flow that the respective pump is able to produce and may have to be adjusted to that limit. The resultant pump flow commands are employed by the system controller 38 to operate the variable displacement first and second pumps 22 and 24 to produce the commanded flow levels.

Figure 12:
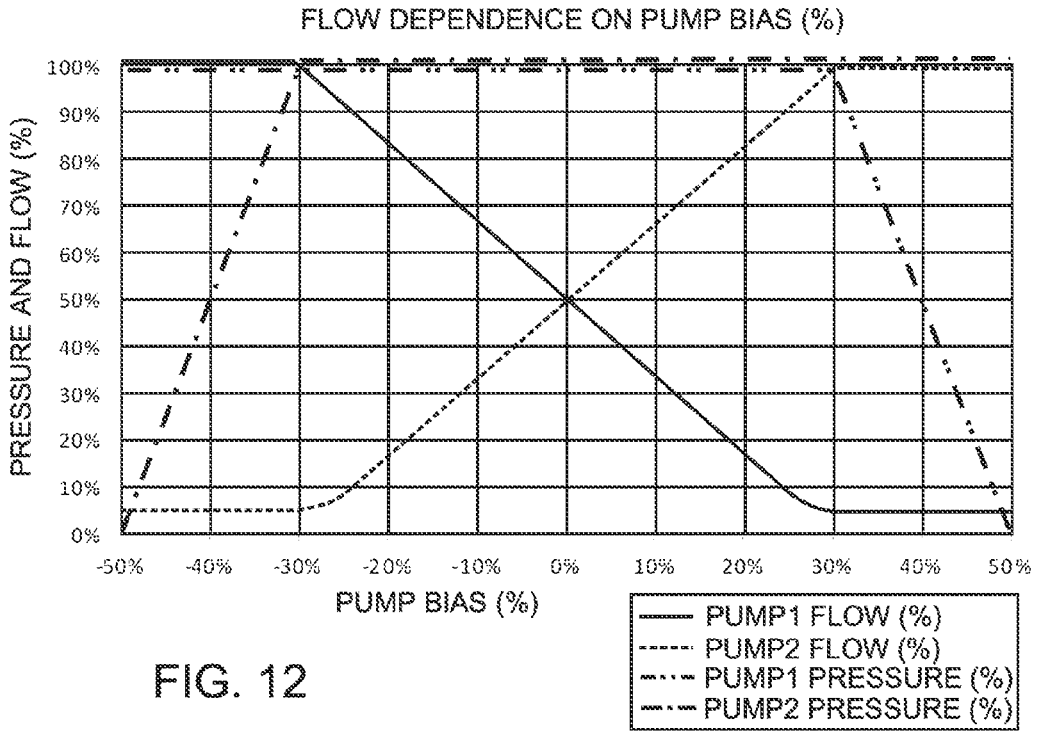
FIG. 12 illustrates how pump flow is commanded and how a pump pressure setpoint is enabled or disabled depending upon the pump bias value.

Then for each hydraulic function, a separate function pressure setpoint percentage is derived for the fluid supplied from each pump 22 and 24. The function pressure setpoint for a hydraulic function is either enabled or disabled for a particular pump depending on whether that hydraulic function is receiving fluid from that pump. This produces a pair of function pressure setpoint percentages Pump1_PS_% and Pump2_PS_% for each hydraulic function at step 114. FIG. 12 illustrates how a function pressure setpoint for a pump is enabled or disabled depending upon the pump bias value. It can be seen from the graph that once a hydraulic function is allocated 100% of flow command from one pump, the other pump's pressure setpoint for this function is progressively disabled. For instance when a hydraulic function's Pump Bias is at −35%, there is no need to hold the outlet pressure of the second pump 24 (Pump 2) at a high level, since the respective hydraulic function is already allocated 100% of its needs from Pump 1.

The following equations are used to implement this relationship:

$$\text{Pump1}_PS\%=\text{MIN}(1,\text{MAX}(0,1/(1-FA_\text{Flow_Range})-2*\text{Pump_Bias}/(1-FA_\text{Flow_Range}))$$

$$\text{Pump2}_PS\%=\text{MIN}(1,\text{MAX}(0,1/(1-FA_\text{Flow_Range})+2*\text{Pump_Bias}/(1-FA_\text{Flow_Range}))$$

For each of the hydraulic function a pair of function pressure setpoints for fluid supplied by each pump 22 and 24 then is calculated. The function pressure setpoint for a given hydraulic function is dependent on the pressure in the function's hydraulic actuator 16-19 resulting from the load forces acting on the hydraulic actuator. That actuator pressure is measured by the actuator pressure sensors, e.g., sensors 55 and 56 for the swing function 41. For each hydraulic function, the associated pressure setpoint percentage, Pump1_PS_% is multiplied by the respective measured actuator pressure to produce a Function Pressure Setpoint for the first pump 22, and the other associated pressure setpoint percentage, Pump2_PS_% is multiplied by the respective measured actuator pressure to produce a Function Pressure Setpoint for the second pump 24.

Thereafter at step 115, a Pump Pressure Setpoint for the output pressure of the first pump 22 is determined by the greatest Function Pressure Setpoint among all the hydraulic functions 41-44. Similarly, a Pump Pressure Setpoint for the output pressure of the second pump 24 is determined by the greatest Function Pressure Setpoint among all the hydraulic functions 41-44. The function controllers 51-54 operate their associated valve assemblies 45-48, respectively, in ways which ensure that the respective pump pressure setpoint level is maintained in the first and second supply conduits 29 and 29 connected to the first and second pumps.

The ability of the first and second pumps 22 and 24 to satisfy the aggregate demand for fluid flow from all the hydraulic actuators 41-44 also may be limited by the maximum power output of the prime mover, e.g., internal combustion engine 25, that drives the pumps. When the aggregate fluid flow demand exceeds the power capability of the prime mover, traditional power limiting techniques on excavators either equally retarded the flow from each pump or equally limited the maximum displacement of both pumps to remain within the power limit of the machine Those previous systems often relied on inefficient methods to direct the equal pump power, unequally to the hydraulic functions. One such method selectively added restrictions to low pressure hydraulic functions (e.g., the bucket) to utilize pump flow and thus power primarily higher pressure functions (e.g., the boom) when multi-function operations were commanded.

Figure 13:
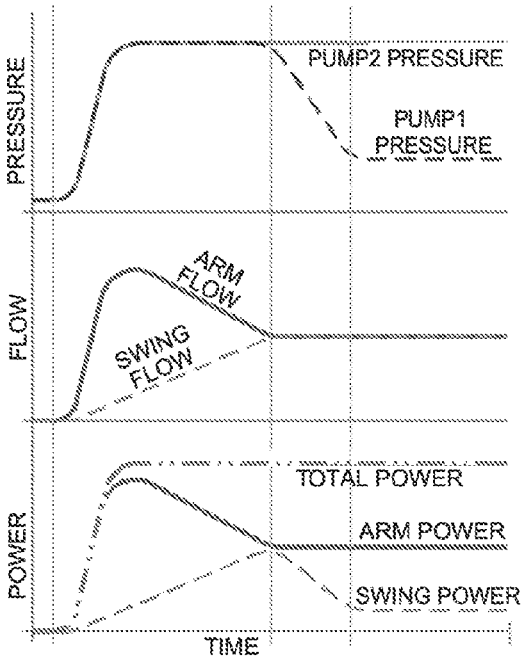
FIG. 13 PRIOR ART
FIGS. 13 and 14 depict the pressure, flow and power characteristics of a previously used power limiting technique and similar characteristics that occur with the a power priority algorithm employed in the present flow allocation process.
Figure 14:
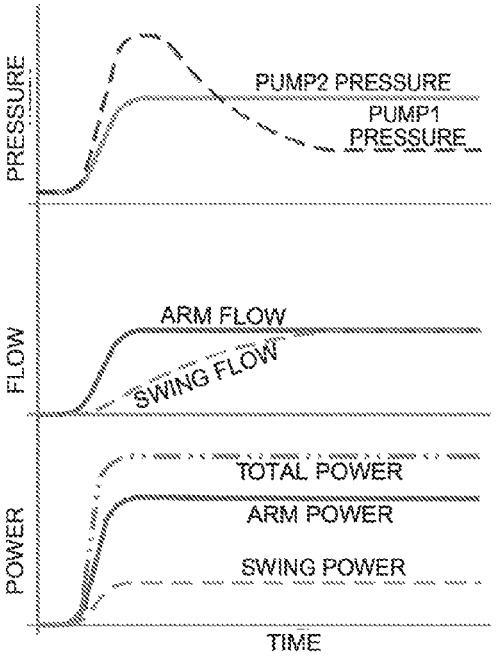

The flow allocation process 100 responds to power limitations in a manner that retains efficiency without losing the multi-function power priority expected by excavator operators. That is accomplished by a power priority algorithm that allocates the available engine power to the pumps based on the operator commands. FIG. 13 illustrates the pressure, flow and power characteristics resulting from a prior power limiting technique as compared to similar characteristics during the present power priority algorithm in FIG. 14. The latter figure shows the power delivery to the swing hydraulic function 41 is limited to an unequal amount in comparison to the arm hydraulic function 43, i.e., the arm has power priority over the swing. Also the pressure of the second pump 24 (Pump 2), supplying flow to the arm hydraulic function, is constant and a low value in comparison to the exemplary prior power limiting technique. In addition, the pressure of the first pump 22 (Pump 1), delivering flow to the swing hydraulic function, is coupled to the power limit for the first pump. Because the arm hydraulic function at this time is more efficient and the operation is power limited, the same end position of arm motion and swing rotation can be achieved in less time than with the prior, or conventional, control methodology.

Figure 15:
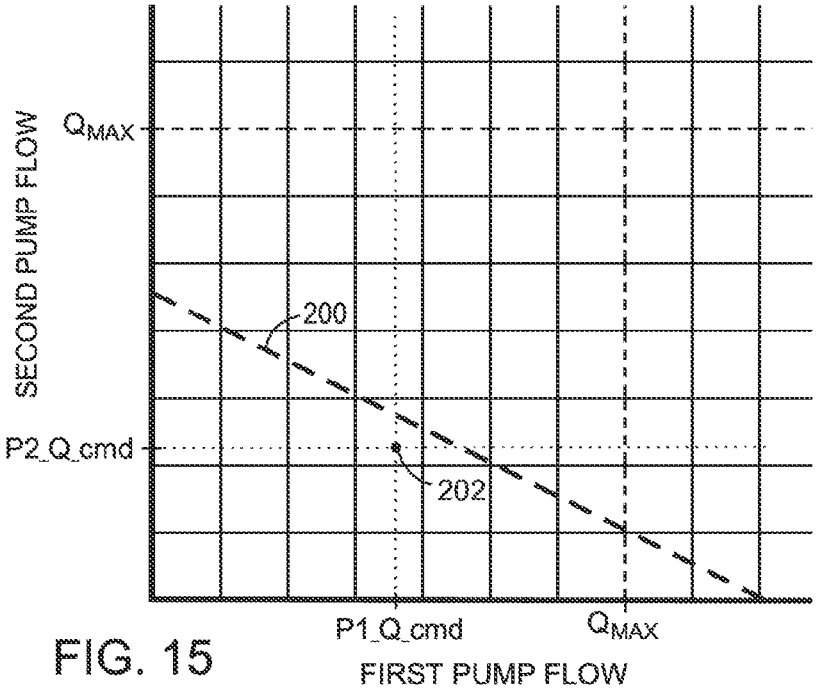
FIG. 15 illustrates how a maximum available power from the engine of the excavator limits the magnitude of fluid flows produced by the two pumps.

FIG. 15 provides an overview of the power priority algorithm in the context of a graph of the magnitude of the fluid flows produced by the first and second pumps 22 and 24. Unlike the previous flow percentage graphs, the axes on FIG. 15 are in units of flow, such as liters per hour. The dashed diagonal line 200 represents a flow limitation due to the maximum engine power. That power limit flow line 200 intersects the axes at flow levels that would be produced by the respective pump operating alone at the previously determined outlet pressure and consuming the entire maximum engine power. Note that the axis intersections for the power limit flow line 200 are different due to the different outlet pressure levels. The power limit flow line is linear between those axis intersection points and can be defined by a linear equation. It should be understood that the pump outlet pressures may change each time the flow allocation process 100 is executed depending on the variation of loads applied to the various functions being powered by the associated pump.

When both pumps are supplying substantial flow, their respective commanded flow levels (P1_Q_cmd and P2_Q_cmd) produce a commanded pump flow point, for example point 202, on the graph. When the commanded pump flow point is on or below the power limit flow line 200, as for point 202, the engine is able to drive both pumps to produce both commanded flow levels. If, however the commanded pump flow point is above the power limit flow line 200, the engine lacks sufficient power capability to drive both pumps to satisfy the commanded flow levels. As a consequence, the outlet flow from one or both pumps must be reduced to a level at which the commanded pump flow point is on or below the power limit flow line. Preferably the resultant commanded pump flow point is on the power limit flow line as that does not reduce the flows more that necessary. It should be understood that the resultant commanded pump flow point also cannot exceed the maximum flow capacity ($Q_{MAX}$) of either pump.

The flow allocation process 100 continues at step 116 on FIG. 9 by implementing the power priority algorithm. Here the power limit flow function represented by line 200 is derived by calculating the axis intercept points and defining the linear relationship of points between those axis intercept points. Then at step 118 The system controller 38 determines whether the flow commands for the pumps exceed the power limit flow. That is from a graphical perspective, whether the commanded pump flow point 202 is above the power limit flow line 200 in FIG. 15.

When in the depicted example that limit is not exceed the flow allocation process 100 terminates since the engine is able to drive the two pumps 22 and 24 to provide the commanded flow levels.

Otherwise when the pump flow commands exceed the power limit flow, the flow allocation process 100 branches to step 120 at which a Weighted Power Command is calculated for each hydraulic function 41-44. The motion of each hydraulic function in each direction is assigned a Power Gain value that denotes its relative flow priority with respect to the other hydraulic functions on the machine. The Table 1 provides an example of a set of power gains for the excavator 10.

TABLE 1

| Hydraulic Function | Power Gain |
|---|---|
| Bucket Curl | 1.0 |
| Bucket Dump | 1.0 |
| Boom Up | 7.0 |
| Boom Down | 0.0 |
| Arm In | 3.0 |
| Arm Out | 3.0 |
| Swing | 1.0 |

Note that the Power Gain for the boom up direction is relatively large because the load forces due to gravity have to be overcome by that motion. In contrast, the same load forces enable the boom to lower without any appreciable hydraulic power. Also note that the swing function has only a single Power Gain as the load force is identical in both swing directions.

For one of the hydraulic function 41-44 at step 120, the function's allocated flow from the first pump 22 is multiplied by the respective Power Gain to derive the Weighted Power Command for that function and the first pump. The same function's allocated flow from the second pump 24 is multiplied by the respective Power Gain to derive the Weighted Power Command for that function and the second pump. That step is repeated for every hydraulic function 41-44.

Then the Weighted Power Commands are summed separately for each of the first and second pumps 22 and 24 at step 122. The proportion of the Weighted Power Command Sum (WPCS) for each pump to the aggregate of the those sums is calculated at step 124 which provides a Relative Power Allocation (RPA) for each pump. Specifically, the Relative Power Allocation for the first pump 22 is derived from the expression P1_RPA=P1_WPCS/(P1_WPCS+P2_WPCS).

Figure 16:
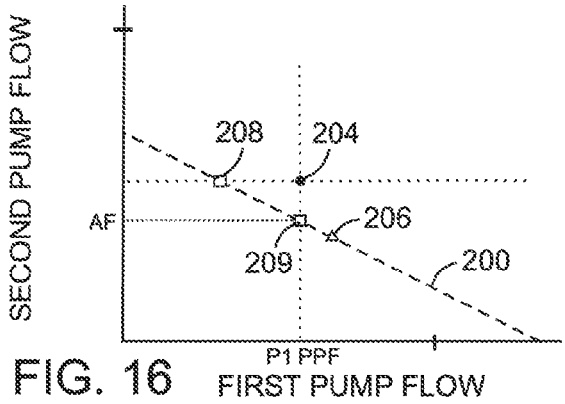
FIGS. 16-18 depict how the flows from the two pumps are adjusted when the desired flows cannot be achieved due to the maximum available power from the engine.

Next at step 126 the maximum available power is apportioned between the two pumps based on the ratio of their Relative Power Allocations and pressure setpoints. This produces a pair of Preferred Power Flow (PPF) levels for the pumps as given by:

$$P1_PPF=K^{*}\text{Max Power}/(P1_PS+(P2_RPA/P1_RPA)^{*}P2_PS))$$

$$P2_PPF=K^{*}\text{Max Power}/(P2_PS+(P1_RPA/P2_RPA)^{*}P1_PS))$$

where K is a conversion constant for units of measurement, P1_PS is the pressure setpoint for the first pump 22, P2_PS is the pressure setpoint for the second pump 24, P1_RPA is the Relative Power Allocation for the first pump, and P2_RPA is the Relative Power Allocation for the second pump. The Preferred Power Flows for the first and second pumps 22 and 24 define a Preferred Power Allocation point along the power limit flow line 200, for example point 206 in FIG. 16.

Figure 18:
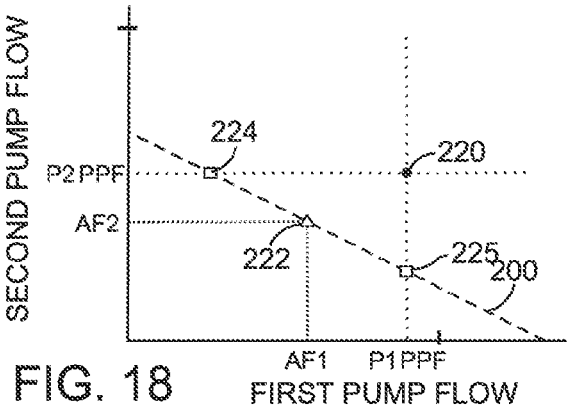

The exemplary embodiment of the flow allocation process 100 adjusts one or both of the flows in response to the Preferred Pump Flows. This case is shown in FIG. 18. The pump flow that is adjusted is the one that produces a combined flow point that is closest to the Preferred Power Allocation point on the power limit flow line 200. Consider a first example depicted in FIG. 16 where the Preferred Pump Flow point is 204 and the Preferred Power Allocation point 206 are shown. Separately adjusting the Preferred Pump Flows for the first and second pumps 22 and 24 yields adjusted flow points 208 and 209, respectively, on the power limit flow line 200. Because adjusted flow point 209 for the second pump 24 is closer to the Preferred Power Allocation point 206, the Preferred Pump Flow (P2_PPF) for the second pump 24 is decreased to the Adjusted Pump Flow level (AF). The flow allocation process 100 then terminates. The original Preferred Pump Flow level (P1_PPF) is used to control the first pump 22 and the Adjusted Pump Flow level (AF) is used to operate the second pump 24.

Figure 17:
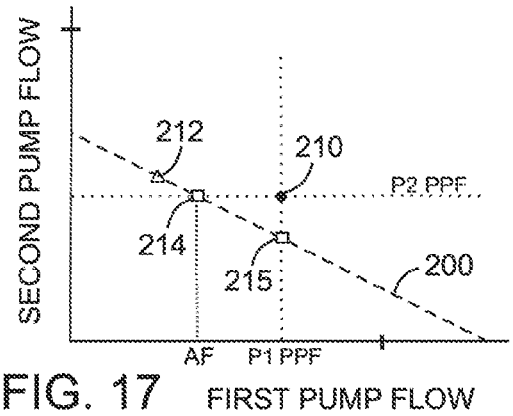

Consider a second example illustrated in FIG. 17 in which the Preferred Pump Flow point 210 and the Preferred Power Allocation point 212 are depicted. Adjusting the Preferred Pump Flow separately for the first and second pumps 22 and 24 yields points 214 and 215, respectively, on the power limit flow line 200. Because flow point 214 for the first pump 24 is closer to the Preferred Power Allocation point 212, the Preferred Pump Flow (P1_PPF) for the first pump 22 is changed to the Adjusted Pump Flow level (AF). The flow allocation process 100 then terminates. The original Preferred Pump Flow level (P2_PPF) is used to control the second pump 24 and the Adjusted Pump Flow level (AF) is used to operate the first pump 22.

A third example, illustrated in FIG. 18, has a Preferred Pump Flow point 220 and a Preferred Power Allocation point 222. When the Preferred Pump Flows are adjusted separately for the first and second pumps 22 and 24, the resultant points 224 and 225 are equidistantly spaced along the power limit flow line 200 on opposite sides of the Preferred Power Allocation point 222. Now the flows for both pumps 22 and 24 are ratiometrically reduced to produce separate Adjusted Pump Flow levels (AF1 and AF2) that are used respectively to operate the first and second pumps.

After the Adjusted Pump Flow level for one or both of the pumps has been established, the corresponding function pump flow levels for every function are adjusted proportionally. That is the proportion that the Adjusted Pump Flow level is of the Preferred Pump Flow level is used to adjust the function pump flow level of that pump at each hydraulic function by the same proportion. The resultant function pump flow levels and the function pressure setpoints are used to control operation of the inlet valves in the valve assemblies 45-48 of the hydraulic functions 41-44 so that the respective hydraulic actuators 16-19 are driven as commanded by the operator.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A method for allocating flow of fluid from first and second pumps to a plurality of hydraulic actuators, said method comprising steps of:

(a) producing a plurality of flow commands, each of which specifies an amount of flow desired to be applied to a different one of the plurality of hydraulic actuators;

(b) calculating an allocation pump bias for each of the plurality of hydraulic actuators, the allocation pump bias being calculated using a flow allocation gain for each of the plurality of hydraulic actuators;

(c) for a given one of the plurality of hydraulic actuators:

(1) using the allocation pump bias to determine a first portion of the amount of flow specified by the flow command for the given hydraulic actuator which is to be provided by the first pump and to determine a second portion of the amount of flow specified by the flow command for the given hydraulic actuator which is to be provided by the second pump, (2) deriving a first flow level in response to the first portion and the flow command for the given hydraulic actuator, and (3) deriving a second flow level in response to the second portion and the flow command for the given hydraulic actuator;

(d) determining a maximum power level for a prime mover that drives the first and second pumps;

(e) defining a power limit flow function using at least a fluid flow level producible by the first pump and a fluid flow level producible by the second pump;

(f) determining if the plurality of flow commands exceeds the power limit flow function;

(g) operating the first pump in response to the first flow level; and (h) operating the second pump in response to the second flow level.

2. The method as recited in claim 1 wherein deriving the first flow level comprises multiplying the flow command for the given hydraulic actuator by the first portion; and deriving the second flow level comprises multiplying the flow command for the given hydraulic actuator by the second portion.

3. The method as recited in claim 1 wherein step (c) further comprises operating one valve in response to the first flow level to supply fluid from the first pump to the given one of the plurality of hydraulic actuators, and operating another valve in response to the second flow level to supply fluid from the second pump to the given one of the plurality of hydraulic actuators.

4. The method as recited in claim 1 further comprising repeating step (c) for each of the plurality of hydraulic actuators; and wherein the first pump is operated in response to all the first flow levels of all the plurality of hydraulic actuators and the second pump is operated in response to all the second flow levels of all the plurality of hydraulic actuators.

5. The method as recited in claim 4 wherein the first pump is operated in response to a first pump flow command produced by summing all the first flow levels, and the second pump is operated in response to a second pump flow command produced by summing all the second flow levels.

6. The method as recited in claim 1 further comprising:

determining a maximum flow level that can be produced by the first and second pumps being driven by the prime mover operating at the maximum power level; and in response to the first flow level and the second flow level for all of the plurality of hydraulic actuators, determining a first aggregate flow level required to be produced by the first pump and determining a second aggregate flow level required to be produced by the second pump.

7. The method as recited in claim 1 further comprising, when the plurality of flow commands exceeds the power limit flow function, altering a calculation of at least one of the flow commands so that the plurality of flow commands is not greater than the power limit flow function.

8. The method as recited in claim 1 further comprising producing a first pump pressure setpoint for the first pump in response to load forces acting on each of the plurality of hydraulic actuators; and producing a second pump pressure setpoint for the second pump in response to load forces acting on each of the plurality of hydraulic actuators.

9. The method as recited in claim 1 further comprising:

in step (c) producing a first Function Pressure Setpoint for the first pump in response to the first portion and a load force acting on the given hydraulic actuator, and producing a second Function Pressure Setpoint for the second pump in response to the second portion and the load force;

repeating step (c) for each of the plurality of hydraulic actuators;

producing a first Pump Pressure Setpoint for the first pump in response to the first Function Pressure Setpoints for the plurality of hydraulic actuators; and producing a second Pump Pressure Setpoint for the second pump in response to the second Function Pressure Setpoints for the plurality of hydraulic actuators.

10. The method as recited in claim 9 wherein producing the first Pump Pressure Setpoint includes determining the greatest Function Pressure Setpoint for the first pump among the plurality of hydraulic actuators; and producing the second Pump Pressure Setpoint includes determining the greatest Function Pressure Setpoint for the second pump among the plurality of hydraulic actuators.

11. The method as recited in claim 1 further comprising when the plurality of flow commands exceeds the power flow limit function, calculating a weighted power command for each of the plurality of hydraulic actuators;

summing the weighted power command for each of the plurality of hydraulic actuators for the first pump;

summing the weighted power command for each of the plurality of hydraulic actuators for the second pump;

deriving a first pump relative power allocation and a second pump relative power allocation; and apportioning the maximum power level between the first pump and the second pump based on at least the first pump relative power allocation and the second pump relative power allocation.

12. The method as recited in claim 1 wherein the fluid flow level producible by the first pump defines a first pump axis intercept point and the fluid flow level producible by the second pump defines a second pump axis intercept point, the first pump axis intercept point and the second pump axis intersect point defining the power limit flow function.

13. The method as recited in claim 1 wherein the flow allocation gain is a numerical term with a sign and a magnitude, the sign establishing a flow allocation direction toward either the first pump or the second pump, and the magnitude establishes an amount of movement toward either the first pump or the second pump.

14. A method for allocating flow of fluid from first and second pumps to a plurality of hydraulic actuators, said method comprising steps of:

(a) producing a plurality of flow commands, each of which specifies an amount of flow desired to be applied to a different one of the plurality of hydraulic actuators;

(b) determining a portion of an aggregate maximum flow output of both the first and second pumps that is required to satisfy the amount of flow specified by the flow command for each of the plurality of hydraulic actuators;

(c) in response to the proportion of the aggregate maximum flow output, calculating an allocation pump bias for each of the plurality of hydraulic actuators, the allocation pump bias being calculated using a flow allocation gain for each of the plurality of hydraulic actuators;

(d) for a given one the plurality of hydraulic actuators:

(1) using the proportion of the aggregate maximum flow output to determine a first portion of the amount of flow specified by the flow command for the given hydraulic actuator which is to be provided by the first pump and a second portion of the amount of flow specified by the flow command for the given hydraulic actuator which is to be provided by the second pump, (2) altering the first portion and the second portion in response to the plurality flow commands, thereby producing an altered first portion and an altered second portion for the given hydraulic actuator, (3) deriving a first flow level in response to the altered first portion and the flow command for the given hydraulic actuator, and deriving a second flow level in response to the altered second portion and the flow command for the given hydraulic actuator;

(e) repeating step (d) for each of the plurality of hydraulic actuators;

(f) defining a power limit flow function using at least a maximum flow level producible by the first pump and a maximum flow level producible by the second pump; and (g) determining if an aggregate of flow commands exceeds the power limit flow function.

15. The method as recited in claim 14 wherein altering the first portion and the second portion for a given hydraulic actuator comprises altering the first portion by weighted versions of the flow commands for the other hydraulic actuators, and altering the second portion by the weighted versions of the flow commands for the other hydraulic actuators, wherein each flow command for the other hydraulic actuators is weighted based on an amount of influence that the respective hydraulic actuator has on allocation of flow from the first and second pumps.

16. The method as recited in claim 14 wherein deriving a first flow level comprises multiplying the flow command for the given hydraulic actuator by the altered first portion, and deriving a second flow level comprises multiplying the flow command for the given hydraulic actuator by the altered second portion.

17. The method as recited in claim 14 wherein step (d) further comprises operating one valve in response to the first flow level to supply fluid from the first pump to the given one of the plurality of hydraulic actuators, and operating another valve in response to the second flow level to supply fluid from the second pump to the given one of the plurality of hydraulic actuators.

18. The method as recited in claim 14 further comprising:

deriving a first pump flow command in response to all the first flow levels;

operating the first pump in response to the first pump flow command;

deriving a second pump flow command in response to all the second flow levels; and operating the second pump in response to the second pump flow command.

19. The method as recited in claim 18 wherein the first pump flow command is derived by summing all the first flow levels, and the second flow command is derived by summing all the second flow levels.

20. The method as recited in claim 14 further comprising producing a first pump pressure setpoint for fluid from the first pump in response to load forces acting on each of the plurality of hydraulic actuators; and producing a second pump pressure setpoint for fluid from the second pump in response to load forces acting on each of the plurality of hydraulic actuators.

21. The method as recited in claim 20 wherein producing a first pump pressure setpoint comprises:

for each of the plurality of hydraulic actuators, producing a function pressure setpoint in response to a load force acting on that hydraulic actuator;

producing a first pump pressure setpoint in response to the function pressure setpoints for those hydraulic actuators which receive fluid from the first pump; and producing a second pump pressure setpoint in response to the function pressure setpoints for those hydraulic actuators which receive fluid from the second pump.

22. The method as recited in claim 21 wherein producing a first pump pressure setpoint selects a function pressure setpoint having a greatest value, and producing a second pump pressure setpoint selects a function pressure setpoint having a greatest value.

23. The method as recited in claim 21 further comprising controlling pressure of the fluid from the first pump in response to the first pump pressure setpoint; and controlling pressure of the fluid from the second pump in response to the second pump pressure setpoint.

24. The method as recited in claim 14 further comprising:

determining a maximum power level for a prime mover that drives the first and second pumps; and in response to the first flow level and the second flow level for all the plurality of hydraulic actuators, determining a first aggregate flow level desired to be produced by the first pump and determining a second aggregate flow level desired to be produced by the second pumps.

25. The method as recited in claim 24 further comprising when the first aggregate flow level desired to be produced by the first pump exceeds the maximum flow level producible by the first pump or the second aggregate flow level desired to be produced by the second pump exceeds the maximum flow level producible by the second pump, altering a calculation of the first aggregate flow level desired to be produced by the first pump so that the first aggregate flow level desired to be produced by the first pump is not greater than the maximum flow level producible by the first pump, or altering a calculation of the second aggregate flow level desired to be produced by the second pump, so that the second aggregate flow level desired to be produced by the second pump is not greater than the maximum flow level producible by the second pump.

26. A method for allocating flow of fluid from first and second pumps to a plurality of hydraulic actuators, said method comprising steps of:

(a) producing a plurality of flow commands, each of which specifies an amount of flow desired to be applied to a different one of the plurality of hydraulic actuators;

(b) for a given one the plurality of hydraulic actuators:

(1) determining a proportion of an aggregate maximum flow output of both the first and second pumps that is required to satisfy the flow command for the given hydraulic actuator, (2) in response to the proportion of the aggregate maximum flow output, deriving an initial pump bias value denoting an apportionment of flow from the first and second pumps to the given hydraulic actuator, if no other hydraulic actuator is active, (3) producing an allocation pump bias value by altering the initial pump bias value in response to the plurality flow commands for all the plurality of hydraulic actuators, the allocation pump bias value being calculated using a flow allocation gain for each of the plurality of hydraulic actuators, the allocation pump bias value denoting an apportionment of flow from the first and second pump to the given hydraulic actuator, (4) in response to the allocation pump bias value, deriving a first proportion of the maximum flow output of the first pump to be applied to the given hydraulic actuator and deriving a second proportion of the maximum flow output of the second pump to be applied to the given hydraulic actuator;

(c) repeating step (b) for each of the plurality of hydraulic actuators;

(d) determining a maximum power level for a prime mover that drives the first and second pumps;

(e) defining a power limit flow function using at least a maximum fluid flow level producible by the first pump and a maximum fluid flow level producible by the second pump;

(f) determining if the plurality of flow commands exceeds the power limit flow function; and (g) operating one valve in response to the first proportion and the flow command for the given hydraulic actuator to control fluid flow from the first pump, and operating another valve in response to the second proportion and the flow command for the given hydraulic actuator for the given hydraulic actuator to control fluid flow from the second pump.

27. The method as recited in claim 26 wherein deriving the initial pump bias value employs a predefined relationship between the flow command and the amount of flow provided by each of the first and second pumps.

28. The method as recited in claim 26 wherein producing the allocation pump bias value applies a weight factor to each flow command to produce a weighted flow proportion, and then applies all the weighted flow proportions to the initial pump bias value.

29. The method as recited in claim 28 wherein producing the allocation pump bias value further comprises adding the weighted flow proportions to the initial pump bias value.

30. The method as recited in claim 26 wherein the one valve is operated in response to a first flow level derived from the first proportion and flow command, and the other valve is operated in response to a second flow level derived from the second proportion and flow command.

31. The method as recited in claim 30 further comprising:

deriving a first pump flow command in response to all the first flow levels;

operating the first pump in response to the first pump flow command;

deriving a second pump flow command in response to all the second flow levels; and operating the second pump in response to the second pump flow command.

32. The method as recited in claim 31 wherein the first pump flow command is derived by summing all the first flow levels, and the second flow command is derived by summing all the second flow levels.

33. The method as recited in claim 26 further comprising producing a first pump pressure setpoint for the first pump in response to load forces acting on at least some of the plurality of hydraulic actuators; and producing a second pump pressure setpoint for the second pump in response to load forces acting on at least some of the plurality of hydraulic actuators.

34. The method as recited in claim 33 further comprising operating the first pump in response to the first pump pressure setpoint; and operating the second pump in response to the second pump pressure setpoint.

35. The method as recited in claim 26 further comprising:

for each given hydraulic actuator, deriving a first flow level from the first proportion and the flow command for that given hydraulic actuator, and deriving a second flow level from the second proportion and flow command for that given hydraulic actuator; and in response to the first and second flow levels for all the plurality of hydraulic actuators, determining a first aggregate flow level desired to be produced by the first pump and determining a second aggregate flow level desired to be produced by the second pump.

36. The method as recited in claim 35 further comprising when the first aggregate flow level desired to be produced by the first pump exceeds the maximum fluid flow level producible by the first pump or the second aggregate flow level desired to be produced by the second pump exceeds the maximum fluid flow level producible by the second pump, altering a calculation of the first aggregate flow level desired to be produced by the first pump so that the first aggregate flow level desired to be produced by the first pump is not greater than the maximum fluid flow level producible by the first pump, or altering calculation of the second aggregate flow level desired to be produced by the second pump, so that the second aggregate flow level desired to be produced by the second pump is not greater than the maximum fluid flow level producible by the second pump.

37. The method as recited in claim 26 wherein the flow allocation gain for at least one of the plurality of hydraulic actuators changes as a function of the initial pump bias value.

* * * * *

UNITED STATES PATENT AND TRADEMARK OFFICE

CERTIFICATE OF CORRECTION

PATENT NO. : 9,032,724 B2
APPLICATION NO. : 13/158631
DATED : May 19, 2015
INVENTOR(S) : Joseph L Pfaff It is certified that error appears in the above-identified patent and that said Letters Patent is hereby corrected as shown below:

In the Claims

Column 20, Claim 14, Line 27, “portion” should be --proportion--.

Column 21, Claim 24, Line 67, “pumps” should be --pump--.

Column 22, Claim 26, Line 38, “pump” should be --pumps--.

Column 24, Claim 36, Line 24, “altering calculation” should be --altering a calculation--.

Signed and Sealed this
Twenty-second Day of September, 2015

Michelle K. Lee

Michelle K. Lee
*Director of the United States Patent and Trademark Office*